US005524896A

United States Patent [19]

Brotz

[11] Patent Number: 5,524,896

[45] Date of Patent: Jun. 11, 1996

[54] GAME UTILIZING A CHANCE SELECTION DEVICE

[76] Inventor: Gregory R. Brotz, P.O. Box 1322, Sheboygan, Wis. 53081

[21] Appl. No.: 391,191

[22] Filed: Feb. 21, 1995

[51] Int. Cl.[6] ..... A63F 7/40; A63F 3/00

[52] U.S. Cl. ..... 273/241; 273/142 R; 273/425; 273/424

[58] Field of Search ..... 273/353, 424, 273/425, 236, 241, 142 R

[56] References Cited

U.S. PATENT DOCUMENTS 4,357,017 11/1982 Schneider et al. ..... 273/246
4,736,954 4/1988 Haney et al. ..... 273/236

*Primary Examiner*—Benjamin H. Layno
*Attorney, Agent, or Firm*—William Nitkin

[57] ABSTRACT

A game using a chance selection device being a circular disk having an outer rim and an open circular central portion in which central portion are disposed cross hairs extending perpendicular to one another, the intersection of the cross hairs corresponding to the center of the circular disk, the disk in use being spun on an indicia selection surface having a plurality of indicia arrayed thereon, such disk slowing down, falling over and coming to rest on such surface with the intersection of the cross hairs indicating the randomly selected indicia located immediately below the intersection of the cross hairs. The indicia selection surface can be on a planar sheet, a planar board or a substantially circular concave game board.

5 Claims, 1 Drawing Sheet

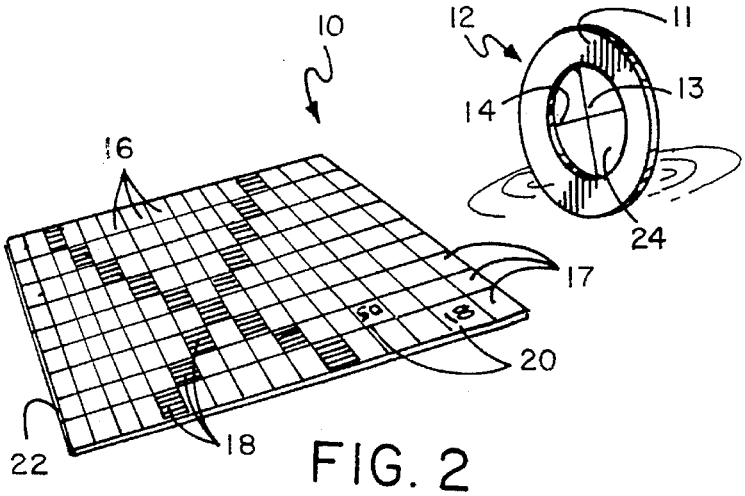
FIG. 1
FIG. 2
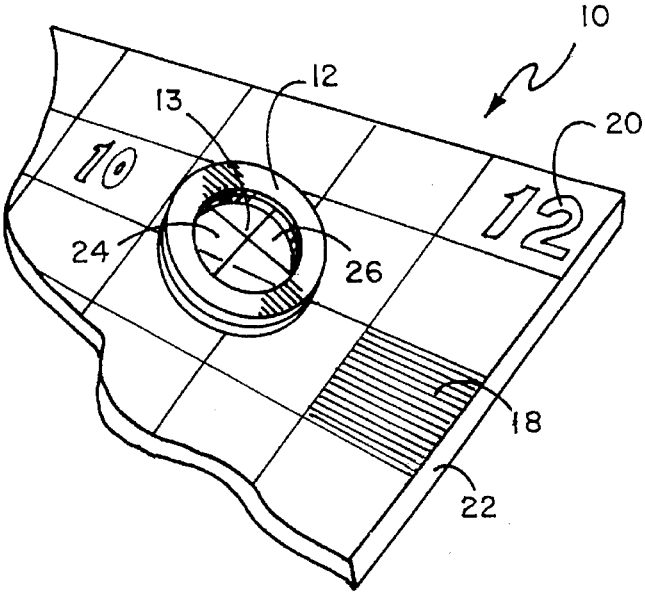
FIG. 3
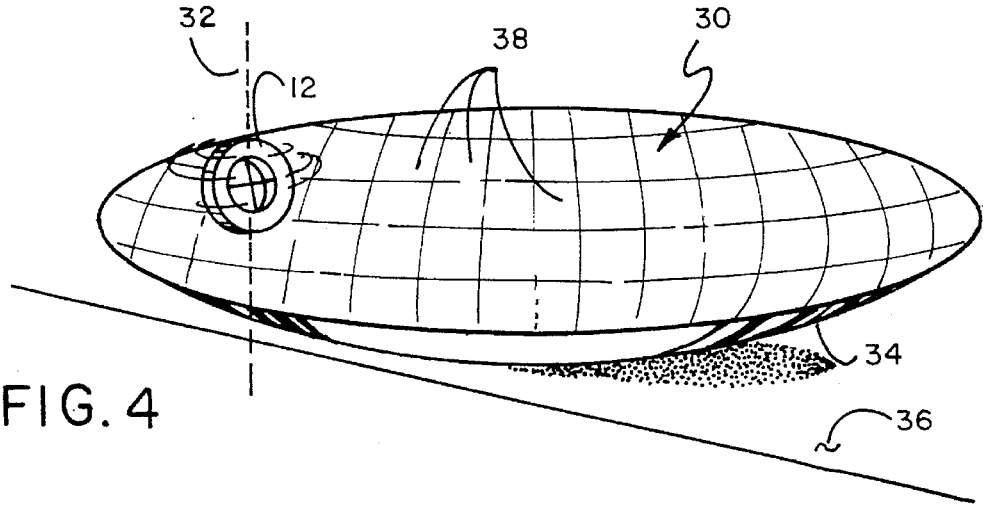
FIG. 4

GAME UTILIZING A CHANCE SELECTION DEVICE

BACKGROUND OF THE INVENTION

1. Field of the Invention

The structure of this invention resides in the area of games having means for random selection of numbers and the like and more particularly relates to a game utilizing a circular disk having cross hairs disposed in its open central portion which disk can be spun on an indicia selection surface before stopping and falling on its side with the intersection of the cross hairs designating the indicia randomly selected thereunder.

2. Description of the Prior Art

Chance selection is an important component of many games. Chance selection of numbers and the like is commonly accomplished in a board game by the players taking turns throwing dice or spinning an arrow on a planar surface, the endpoint of which arrow will come to rest pointing to a segment, a number or other indicia which will indicate the action which a player must take in the game being played.

SUMMARY OF THE INVENTION

It is an object of this invention to provide a game with a chance determination device for the random selection of numbers, colors, segments, indicia and the like arrayed on an indicia selection surface.

It is a further object of this invention to provide a device which can be spun on an indicia selection surface.

It is yet a further object of this invention to provide a chance selection device which can be used in conjunction with many different types of indicia selection surfaces. In one embodiment of the game of this invention the indicia selection surface can be disposed on the top surface of a substantially circular concave game board.

It is a still further object of this invention to provide a chance selection device which will accurately determine the indicia randomly selected.

The game of this invention includes a circular disk having an open central portion surrounded by an exterior rim. Disposed within the open central portion are cross hairs positioned perpendicular to one another and which open central portion allows viewing therethrough. The disk can be spun on an indicia selection surface on which is disposed a plurality of different indicia such as spots of color, segments containing different numbers, rows or columns of different items or other arrangement of indicia on a surface. After being spun, the disk slows down and falls over on its side, coming to rest on the indicia selection surface and the intersection of the cross hairs accurately designates the randomly selected indicia located directly below the intersection of the cross hairs of the device.

BRIEF DESCRIPTION OF THE DRAWINGS

FIG. 1 illustrates a perspective view of the chance selection device of the game of this invention being a circular disk having an open circular central portion with cross hairs disposed therein intersecting at the center of the disk.

FIG. 2 illustrates a perspective view of one embodiment of an indicia selection surface utilized with the game of this invention.

FIG. 3 illustrates a perspective sectional view of the indicia selection surface of FIG. 2 with the disk of FIG. 1 resting thereon.

FIG. 4 illustrates a perspective view of the embodiment of the game of this invention utilizing a concave game board.

DESCRIPTION OF THE PREFERRED EMBODIMENT(S)

The game of this invention utilizes a chance selection device, being a circular disk 12, as seen in FIG. 1. Disk 12 in a preferred embodiment has an open, circular central portion 24 defined therein with cross hairs 14 extending perpendicular to one another within central portion 24 from four equidistant points on exterior rim 11 of disk 12 within central portion 24. The intersection of cross hairs 14 represents the center point of both the disk and the open central portion.

FIG. 2 illustrates one embodiment of an indicia selection surface being disposed on an indicia selection board 10, which can be used in conjunction with disk 12. Indicia selection board 10, as seen in FIG. 2, has a thickness 22 but which indicia selection surface could also be a planar sheet or any suitable surface. Indicia selection board 10 can have a plurality of different indicia designated thereon, such as numbers or color segments 18 arrayed in a plurality of columns 16 and rows 18. The indicia to be randomly selected can also be arranged in other formats such as non-symmetrical designs not illustrated herein. When disk 12, as seen in FIG. 3, is spun on indicia selection board 10 by a player, it will eventually fall onto its side and come to rest thereon; and the intersection of cross hairs 14 will be positioned over an indicia space 26 or a segment on the indicia selection board which indicia space 26 can be observed through open central portion 24. The intersection 13 of the cross hairs designates the randomly selected indicia space or indicia.

FIG. 4 illustrates a perspective view of a substantially circular concave indicia selection board 30 with a plurality of indicia spaces 38 designated on its top surface. Disk 12 is spun in the concavity of the board, and the board can tip slightly by the weight of the disk as the disk moves around, such as toward an edge of board 30, forcing that edge closer to table surface 36 because the convex bottom 34 of such board allows its movement. Wherever disk 12 spins will cause the portion of the concave indicia game board directly beneath it to move closer to table surface 36 such as along line 32 in FIG. 4. Disk 12 generally will not spin off concave indicia selection board 30. Should it reach an edge thereof, it will spin back inward. Utilizing disk 12 on the shallow concave game board 30 injects an clement of unpredictability to the disk's movement and heightens player interest in the game of this invention.

Disk 12 can be made of plastic, metal, wood or other material. The cross hairs disposed in the open central portion can be made of wire, sturdy thread or other equivalent material which can be tautly disposed within the central portion by being sandwiched therein, adhered by glue or attached by equivalent, well-known means of attachment. The concave game board can be made of plastic, metal or equivalent suitable material.

Although the present invention has been described with reference to particular embodiments, it will be apparent to those skilled in the art that variations and modifications can be substituted therefor without departing from the principles and spirit of the invention.

I claim:

1. A game incorporating random selection by a player of one of a plurality of indicia, comprising:

an indicia selection surface;

a plurality of indicia arrayed on said indicia selection surface;

a circular disk having an exterior rim, a center point and an open central portion defined in said disk, said central portion having a center point corresponding to said center point of said disk;

cross hairs disposed within said open central portion, said cross hairs positioned perpendicular to one another and intersecting one another, said cross hairs extending from four points disposed equidistant from one another on said exterior rim, said intersection of said cross hairs corresponding to said center point of said disk;

said disk in use being spun on said indicia selection surface, slowing, falling over onto its side and coming to rest thereon with said intersection of said cross hairs indicating the randomly selected indicia which is positioned on said surface directly below said intersection, said randomly selected indicia being observable by said player through said open central portion.

2. The game of claim 1 further including a planar sheet having a top surface, said indicia selection surface disposed on said top surface.

3. The game of claim 1 further including a planar board having a top surface, said indicia selection surface disposed on said top surface.

4. The game of claim 1 wherein said open central portion is circular.

5. A game incorporating random selection by a player of one of a plurality of indicia, comprising:

an indicia selection surface;

a plurality of indicia arrayed on said indicia selection surface;

a circular disk having an exterior rim, a center point and an open central portion defined in said disk, said central portion having a center point corresponding to said center point of said disk;

cross hairs disposed within said open central portion, said cross hairs positioned perpendicular to one another and intersecting one another, said cross hairs extending from four points disposed equidistant from one another on said exterior rim, said intersection of said cross hairs corresponding to said center point of said disk;

said disk in use being spun on said indicia selection surface, slowing, falling over onto its side and coming to rest thereon with said intersection of said cross hairs indicating the randomly selected indicia which is positioned on said surface directly below said intersection, said randomly selected indicia being observable by said player through said open central portion; and further including a concave game board having a top surface, said indicia selection surface disposed on said top surface.

* * * * *